US006397407B1

(12) United States Patent
Dahlberg

(10) Patent No.: US 6,397,407 B1
(45) Date of Patent: Jun. 4, 2002

(54) VACUUM TOILET SYSTEM WITH SINGLE PUMP

(75) Inventor: Kjell Dahlberg, BaLeares (ES)

(73) Assignee: SeaLand Technology, Inc., Big Prairie, OH (US)

( * ) Notice: Subject to any disclaimer, the term of this patent is extended or adjusted under 35 U.S.C. 154(b) by 0 days.

(21) Appl. No.: 10/003,318

(22) Filed: Dec. 6, 2001

Related U.S. Application Data

(62) Division of application No. 09/739,274, filed on Dec. 19, 2000.

(51) Int. Cl.[7] ..... E03D 11/00
(52) U.S. Cl. ..... 4/431; 4/321; 4/434; 137/589
(58) Field of Search ..... 4/321, 323, 431–434; 137/565.37, 589, 592

(56) References Cited

U.S. PATENT DOCUMENTS

| | | | | |
|---|---|---|---|---|
| 3,663,970 A | | 5/1972 | Drouhard, Jr. et al. | |
| 3,727,241 A | | 4/1973 | Drouhard, Jr. et al. | |
| 3,811,135 A | | 5/1974 | Drouhard, Jr. et al. | |
| 4,332,041 A | * | 6/1982 | Kristoffersen | 4/431 |
| 4,357,719 A | | 11/1982 | Badger et al. | |
| 4,713,847 A | | 12/1987 | Oldfelt et al. | |
| 4,819,279 A | | 4/1989 | Sigler et al. | |
| 4,865,631 A | | 9/1989 | Stroby et al. | |
| 5,139,655 A | | 8/1992 | Sigler | |
| 5,345,618 A | | 9/1994 | Sigler et al. | |
| 5,408,704 A | | 4/1995 | Bailey et al. | |
| 5,621,924 A | | 4/1997 | Friedman et al. | |
| 5,681,148 A | | 10/1997 | Friedman et al. | |
| 5,732,417 A | | 3/1998 | Pondelick et al. | |
| 6,234,197 B1 | * | 5/2001 | McKiernan et al. | 4/321 |

OTHER PUBLICATIONS

SMC Flyer entitled "Three Way Ball Valves", 1999.
SeaLand Technology "Installation Instructions S–Series Vacuum Pump", Oct., 1998.

* cited by examiner

*Primary Examiner*—Gregory L. Huson
*Assistant Examiner*—Tuan Nguyen
(74) *Attorney, Agent, or Firm*—Nixon & Vanderhye P.C.

(57) ABSTRACT

A multi-position (e.g. three way) valve is operatively connected to a combined vacuum/holding tank for a vacuum toilet system, and to a pump capable of pumping both air and sewage. When the valve is in one position air is pulled from the tank through the pump to increase the vacuum level in the tank, e.g. to above 10 in/Hg. When the valve is moved to a second position by either a float or manual switch operation, the sewage is pumped out of the tank through the pump while surrounding air moves through the valve into the tank.

5 Claims, 2 Drawing Sheets

VACUUM TOILET SYSTEM WITH SINGLE PUMP

This application is a division of application Ser. No. 09/739,274, filed Dec. 19, 2000, pending, the entire content of which is hereby incorporated by reference in this application.

BACKGROUND AND SUMMARY OF THE INVENTION

In vacuum toilet systems, especially for marine use, and for use in other vehicles such as RVs, it is desirable to provide as few components as possible, and to make the systems as inexpensive as possible while still being capable of performing the intended functions in a highly effective manner. This has led to the development of advanced systems which use a single tank as both a vacuum reservoir to effect quick and effective flushing, and as a holding tank for the sewage from the one or more toilets of the system, such as shown in U.S. Pat. Nos. 5,681,148 (the disclosure of which is hereby incorporated by reference herein) and U.S. Pat. No. 4,713,847. While such new technology is highly effective, it cannot be easily or cost effectively retrofit to more traditional systems, such as shown in U.S. Pat. No. 4,819,279. Also for some installations a simpler arrangement is desired than in said patents 5,681,148 and 4,713,847.

According to the present invention a simple system, and method of utilization thereof, are provided which can turn a conventional VHT holding tank into a combined vacuum and holding tank, thereby saving space, which is at a premium in many vacuum tank installations, such as on boats. Simply by adding a conventional three way valve, either manually or automatically operated, and utilizing a pump capable of pumping both air and sewage, a cost effective and highly functional system and method may be provided both for retrofitting existing installations, and for new installations.

According to one aspect of the present invention there is provided a vacuum toilet system comprising: At least one vacuum toilet. A combination sewage holding and vacuum tank operatively connected to the vacuum toilet, the tank having a top and a bottom. A pump capable of pumping air and sewage. An air conduit connected to the tank adjacent the top thereof at a first end, and having a second end. A sewage conduit having a bottom end positioned adjacent the tank bottom, and a top end connected to the pump. The air conduit second end operatively connected to the sewage conduit between the top and bottom ends thereof. A valve connected to the air conduit between the air conduit first end and the sewage conduit, the valve having: a first position in which atmospheric air can pass through the valve into the tank through the air conduit first end, but not directly to the pump; and a second position in which air from the tank passes through the air conduit first end directly to the pump and atmospheric air is substantially precluded from entering the air conduit. A vacuum switch for sensing vacuum level in the tank and controlling the pump in response thereto when the valve is in the second position. And, a second switch for operating the pump when the valve is in the first position for pumping sewage out of the tank. The pump may comprise a bellows operated pump with an inlet (and outlet) containing two in series check valves (each), such as duckbill valves. A preferred commercially available pump is an S-series pump available from Sealand Technology, Inc. of Big Prairie, Ohio.

The valve may be of the type conventionally known as a three way valve, preferably a ball valve, which has a single outlet and two inlets (with or without a completely "off" position). The valve may be manually operated, or automatically (e.g. solenoid) operated depending upon other components of the system and the degree of complexity and level of expense desired or acceptable.

The system may further comprise a float switch for detecting the level of sewage in the tank, the float switch comprising the second switch. In this case typically the valve is a solenoid operated valve which is controlled by the second switch to move the valve to the first position. The system may still further comprise a manually operated switch to control operation of the pump to effect sewage pumpout. In this latter case the valve is controlled by operation of the float switch or the manually operated switch to automatically move to the first position.

Alternatively the second switch may comprise a manually operated switch. The system may then further comprise a float switch which senses the level of sewage in the tank and when a predetermined level is sensed precludes operation of the pump until the valve is in the first position and the second switch is manually activated.

Typically the tank has a top surface and a hollow extension extending above the top surface; and the vacuum switch and air conduit first end are connected to the hollow extension. In this case the second switch may comprise a float switch including a component extending downwardly from the interior of the top surface into the tank.

According to another aspect of the present invention there is provided a method of operating a combined vacuum and holding tank of a vacuum toilet system having a pump capable of pumping either air and sewage, and a multi-position valve, comprising: (a) Sensing the vacuum level in the tank, (b) When the level sensed in (a) is below a predetermined amount controlling the position of the valve and pumping air from the tank through the valve using the pump, until the desired level is reached, and then stopping air pumping using the pump. And, (c) when emptying sewage from the tank is desired, controlling operation of the pump and the position of the valve so that the sewage is pumped from the tank through the pump, and air passes from the atmosphere through the valve into the tank.

Preferably (b) is practiced to operate the pump to pull air from the tank through the valve when the vacuum level in the tank is less than about 10 inches of mercury. Also in the method (b) and (c) may be practiced in part by moving the valve to the desired position manually. Also (c) may be practiced by manually activating a switch to start operation of the pump when the valve is in a position to allow air flow into the tank from the surrounding environment.

It is the primary object of the present invention to provide a simple, versatile, and cost effective vacuum toilet system and method of utilization thereof. This and other objects of the invention will become clear from a detailed description of the invention and from the appended claims.

DETAILED DESCRIPTION OF THE DRAWINGS

Figure 1:
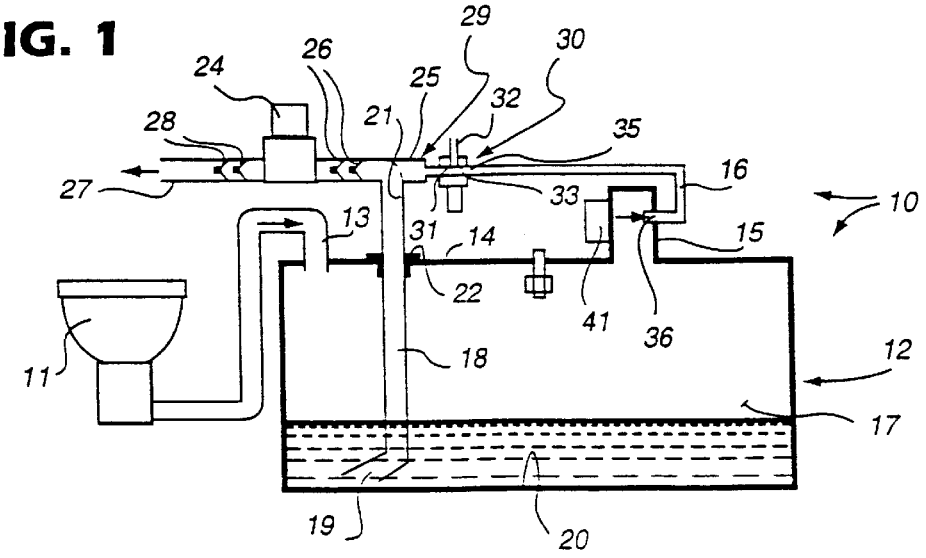
FIG. 1 is a is a schematic side sectional view of an exemplary system according to the present invention with the valve in a position allowing air to be evacuated from the tank and with the vacuum switch operating the pump to effect evacuation.
Figure 3:
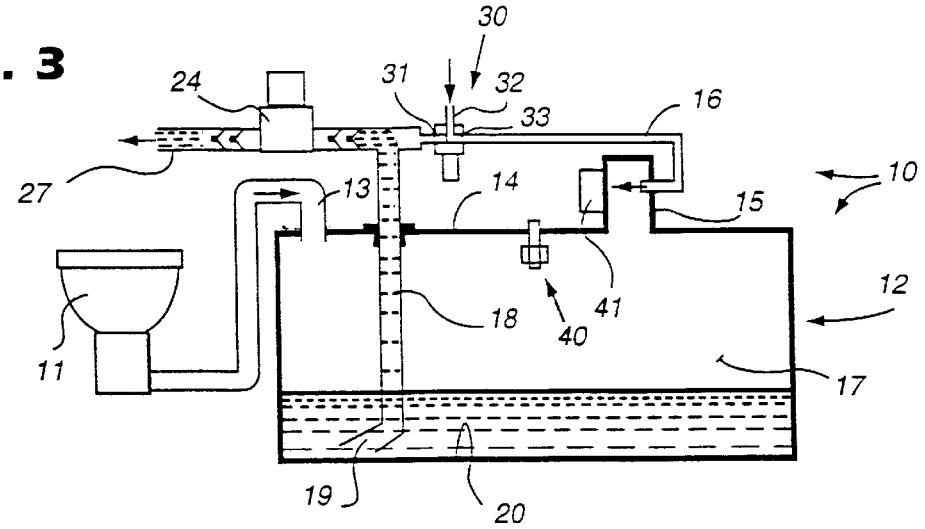
FIGS. 3 and 4 are views like that of FIG. 1 only showing operation of the system during manually activated waste pumping, or automatic waste pumping upon a full condition of the tank, respectively.
Figure 4:
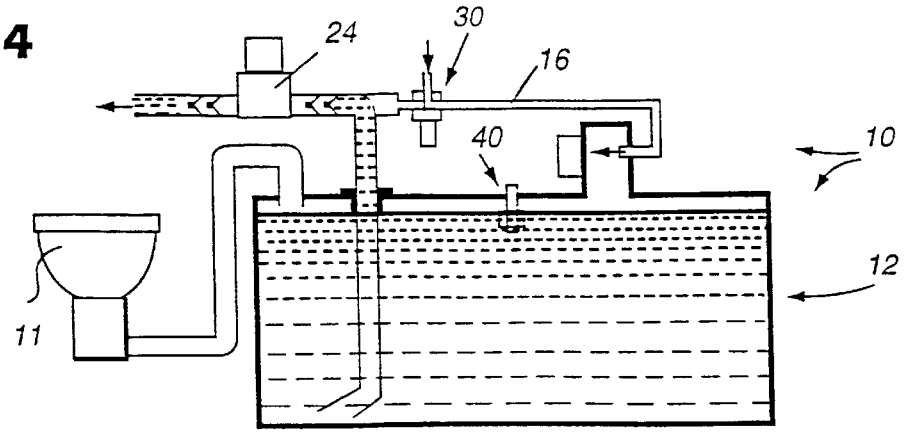

An exemplary vacuum toilet system according to the invention is shown schematically and generally by reference numeral 10 in FIGS. 1, 3 and 4. One or more conventional vacuum toilets 11 is connected to a conventional holding tank 12 with an inlet 13 adjacent the top surface 14 of the tank 12. The tank 12 may be a conventional holding tank (either plastic or metal), such as a Sealand VHT tank, modified according to the present invention.

In the preferred embodiment illustrated the tank 12 has, or has retrofit thereto, a hollow extension 15 extending upwardly from the top surface 14. Connected in fluid communication with the interior 17 of the tank 12, preferably at the hollow interior of extension 15, is a hose or other conduit 16 for providing for the passage of air from or into the tank interior 17. The conduit 16 is connected to the tank 12 at a point where it is substantially impossible, or at least unlikely, for sewage to reach.

Also connected to the interior 17 of tank 12 is a sewage discharge conduit 18 having an open, and preferably angular cut (so that it has an oval cross section), bottom portion 19 adjacent, but slightly spaced from, the bottom 20 of the tank 12. The outlet end 21 of conduit 18 preferably extends through a substantially fluid tight gasketed opening 22 in the top 14 of tank 12.

Instead of a normal vacuum pump, the system 10 includes a pump 24 which is capable of pumping both air and sewage. For example the pump 24 may be a conventional S-series pump available from Sealand. Such a pump has an inlet 25 with a pair of in series check valves, shown schematically at 26 in FIG. 1, and preferably an outlet 27 also with a pair of check valves 28. The check valves 26, 28 are preferably duckbill type. The body of pump 24 preferably comprises a bellows, which is reciprocated to perform the pumping action.

Figure 2:
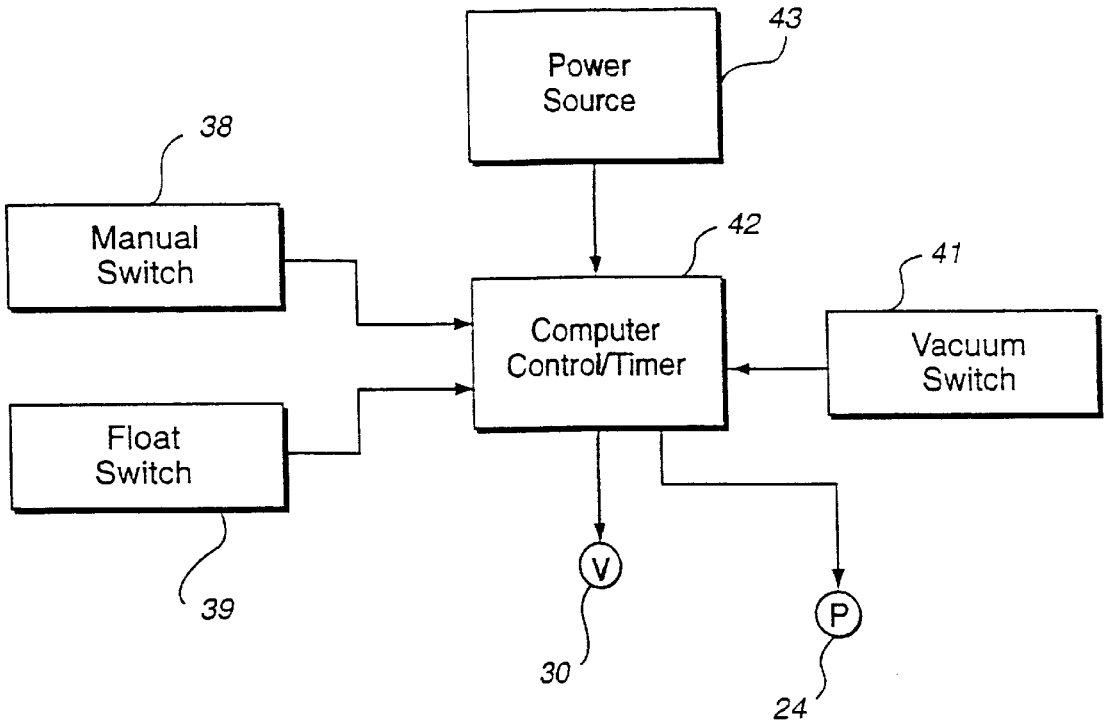
FIG. 2 is a control schematic illustrating the interconnection between components to provide versatile and effective operation of the system of FIG. 1.

The outlet 21 of conduit 18 is operatively connected to the inlet 25 of pump 24, as by a T-connection shown schematically at 29 in FIG. 2. Also the conduit 15 is operatively connected to inlet 25, as though a valve 30.

The position of the valve 30 controls whether air or sewage will be pumped by the pump 24. Preferably the valve 30 is a multi-position valve, such as what is commonly known as a three position valve, having a single outlet 33, and two inlets, 32, 31. A ball valve, such as available from SMC (e.g. a Barb×Barb×Barb Model 350/351-686868), manually actuated valve may be used as the valve 30. However other conventional types of valves (e.g. plug or reciprocating) and actuators (e.g. solenoid or other automatic or remote actuators) may be used. One inlet 32 is connected to atmosphere, while the other inlet 31 is operatively connected to the pump inlet 25 through a standard connection. The outlet 33 is connected to second end 35 of conduit 16, opposite the first end 36 thereof, which is connected to extension 15.

The operation of the pump 24 may be accomplished in a number of different ways. For example there may be a manually actuated switch 38 (see FIG. 2), and/or a float switch 39 (see FIG. 2) responsive to the position of a float mechanism 40 extending downwardly from the interior of the top 14 of the tank 12. Also the pump 24 is operated by a conventional vacuum switch 41, which senses the level of vacuum inside the interior 17 of the tank 12 and if too low (e.g. below about 10 inches of mercury) activates the pump 24 until the desired level of vacuum is restored for effective flushing of the toilet(s) 11.

FIG. 2 is one form that a control schematic according to the invention may take. A conventional computer controller 42, such as one with a built in timer, is operatively connected to a power source 43, such as a battery or generator, and receives inputs from elements 38, 39, 41, and controls elements 24, 30, etc.

Operation of the system 10 to restore a desired level of vacuum in the interior 17 is best explained with respect to FIGS. 1 and 2. With the valve 30 in the position indicated in FIG. 1, in which the outlet 33 is connected to inlet 31, or by automatically moving the valve 30 to that position under control of the computer 42, the vacuum switch 41 senses a low vacuum level in interior 17 of tank 12. In the position of the valve 30 illustrated in FIG. 1, the air is pulled through pump 24 and does not exit through inlet 32, which is positively closed and fluid tight. Through the computer 42 the vacuum switch 41 then causes the pump 24 to run, which pulls air from the interior 17 so that it passes through valve 30 into and through pump 24, as shown by the arrows in FIG. 1. When the desired level of vacuum (e.g. at last about 10 in./Hg) is reached in interior 17, the switch 41 cuts off the pump 24. When a toilet 11 is flushed the vacuum in tank 12 sucks the sewage through inlet 13 into the tank interior 17, which likely reduces the vacuum level to below the desired predetermined valve so that the cycle repeats.

FIG. 3 schematically illustrates the situation when it is desired to pump sewage out of the tank 12 at a suitable disposal location, depending upon local laws or customs. One manually actuates switch 38 (which may be any conventional type of electrical switch), which controls (e.g. through computer 42) the valve 30 to move it to the position illustrated in FIG. 3, where the inlet 32 is connected to outlet 33, and air can move through inlet 32 to tank interior 17, but not directly to the pump 24. Alternatively the valve 30 could have been manually moved to that position. The pump 24 then is powered by source 43 through computer 42 until the desired amount of sewage has been pumped out of the interior 17. The exact control mechanism may vary widely. For example the pump 24 can run until the switch 38 is no longer actuated, or can run under the control of a timer in computer 42, or in any of a variety of other manners. The pump 24 pumps sewage through conduit 18 out of the outlet 27 while air moves into tank 12 through inlet 32, valve 30, and conduit 16, as indicated by the directional arrows in FIG. 3. The air replaces the pumped-out sewage in tank interior 17 to prevent tank implosion or other adverse consequence.

FIG. 4 schematically illustrates a possible scenario where the float switch 39—in sensing a full tank condition—automatically moves the valve 30 to the same position as in FIG. 3, and automatically actuates the pump 24, both through computer control 42. Pumpout may continue for a predetermined amount of time after the sewage level moves below the float 40 (and the switch 39 is deactivated), or in any other suitable manner.

Instead of the operation sequence described above with respect to FIG. 4, the float switch 39 may operate an indicator light and/or block operation of the pump 24, and/or toilet 11, until the switch 38 and valve 30 are manually actuated to move to the position illustrated in FIG. 3. This position may be sensed by a conventional position sensor for the actuator on the valve 30. Then, as described with respect to FIG. 3, a desired volume of sewage is pumped out of the tank 12.

After pumpout of the sewage, pursuant to the procedures of either FIGS. 3 or 4, the valve 30 is either manually or automatically moved to the position in FIG. 1 to allow re-evacuation of the tank 12 so that the toilet 11 will again operate properly.

It will thus be seen that according to the present invention a cost-effective, versatile, and highly functional system and method related to a vacuum toilet have been provided.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A method of operating a combined vacuum and holding tank of a vacuum toilet system having a pump capable of pumping either air or sewage, and a multi-position valve, comprising the step of:

(a) sensing the vacuum level in the tank via a vacuum switch;

(b) when the level sensed in step (a) is below a predetermined amount, positioning the valve into a first position and pumping air from the tank through the valve using the pump, until the desired level is reached, and then stopping air pumping by turning off the pump; and (c) when emptying sewage from the tank is desired, controlling operation of the pump and positioning the valve into a second position so that the sewage is pumped from the tank through the pump via a discharge duct, and air passes from the atmosphere through the valve into the tank via an air duct.

2. A method as recited in claim 1 wherein steps (b) is practiced to operate the pump to pull air from the tank through the valve when the vacuum level in the tank is less than about 10 inches of mercury.

3. A method as recited in claim 1 wherein steps (b) and (c) are practiced in part by moving the valve to the first or second position manually.

4. A method as recited in claim 1 wherein step (c) is practiced by manually activating a second switch to start operation of the pump when the valve is in the second position to allow air flow into the tank from the surrounding environment.

5. A method as recited in claim 1 wherein steps (b) and (c) are practiced in part by moving the valve to the first or second position automatically.

* * * * *